United States Patent [19]

Nelson

[11] Patent Number: 4,463,659

[45] Date of Patent: Aug. 7, 1984

[54] CYLINDER STROKE LIMITER

[75] Inventor: Roger J. Nelson, Cedar Falls, Iowa

[73] Assignee: Deere & Company, Moline, Ill.

[21] Appl. No.: 546,338

[22] Filed: Oct. 27, 1983

[51] Int. Cl.[3] ..... F15B 15/22

[52] U.S. Cl. ..... 91/404; 251/74; 251/294

[58] Field of Search ..... 91/404, 405, 406; 251/74, 294

[56] References Cited

U.S. PATENT DOCUMENTS

| | | | |
|---|---|---|---|
| 2,587,182 | 2/1952 | Livers | 91/404 |
| 2,606,414 | 8/1952 | Dyrr | 91/404 |
| 2,606,532 | 8/1952 | Ziskal | 91/404 |
| 2,699,150 | 1/1955 | Ziskal | 91/405 |
| 3,667,347 | 6/1972 | Patrick | 91/404 |
| 3,905,279 | 9/1975 | Yadon | 92/13.8 |
| 3,967,539 | 7/1976 | Williamson | 91/404 |
| 3,972,265 | 8/1976 | Magnuson | 91/404 |
| 4,151,978 | 5/1979 | Frel | 91/404 |

OTHER PUBLICATIONS

Cessna Aircraft Co., Cylinder with Hydraulic Stroke Control, 1968.

Prince Hydraulics, Internal Stroke Control Cylinder, p. 8, (Date - prior to present invention).

Deere & Company, Remote Cylinder, Hoses, and Arm, 1978, pp. 70-80 and 70-82.

*Primary Examiner*—Paul E. Maslousky

[57] ABSTRACT

A hydraulic cylinder stroke limiter has a valve for controlling fluid flow from a port of the cylinder. A flexible hose has one end fixed to the valve housing and the other end movably supported at the rod end of the cylinder by a pivotal bracket. A cable extends through the hose and is anchored at one end with respect to the bracket and at the other end to a poppet movable to open to close the valve. A stop is mountable on the piston rod to engage the bracket, its movement being communicated by the cable to the poppet to close the valve and prevent further rod retraction.

10 Claims, 8 Drawing Figures

10
12
14
16
20
22
24
26
27
28
30
32
33
34
36
38
40
42
44
46
50
60
62
64
66
70
72
74
76
80

CYLINDER STROKE LIMITER

BACKGROUND OF THE INVENTION

This invention relates to an apparatus for hydraulically controlling the stroke of hydraulic cylinders.

Both mechanical and hydraulic cylinder stroke limiters are currently in production. Of the many variations of hydraulic stroke limiters, some are integral to their cylinder, thereby increasing cylinder cost and decreasing design flexibility since such stroke limiters cannot be added on to existing non-stroke limited cylinders. Many hydraulic stroke limiters include valves which have moving parts which are exposed to the environment, thus requiring sliding seals which can become contaminated. Some have rigid linkages which are exterior to the cylinder and which, if bent, can prevent operation of the cylinder stop system. Such rigid linkage systems may also be difficult to adapt to different cylinder designs since precise alignment of the linkage must be maintained.

SUMMARY OF THE INVENTION

An object of the present invention is to provide an add-on type cylinder stroke limiter which does not require sliding seals.

Another object of this invention is to provide an add-on cylinder stroke limiter which can easily be adapted for use on cylinders of different sizes and styles.

A further object of this invention is to provide an add-on stroke limiter with exterior parts which are flexible and which can withstand a certain amount of deformation.

These and other objects are achieved by the present invention which includes a valve mountable on the head end of a cylinder to control fluid flow from the cylinder. The valve has a housing sealingly coupled to one end of a hollow flexible hose. A poppet is movable in the housing to open and close the valve. One end of a flexible cable is coupled to the poppet. A bracket is pivotally coupled to the rod end of the cylinder and has an arm which is fixed to a hose fitting. The hose fitting is sealingly fixed to the other end of the hose and has an abutment which normally holds the cable so that the cable holds the poppet in an open position. A stop, which is mountable on the piston rod, pivots the bracket upon rod retraction to move the hose fitting and the cable so that a spring can move the poppet to a closed position preventing further rod retraction.

DETAILED DESCRIPTION

Figures 1, 2, 3, 4, 5:
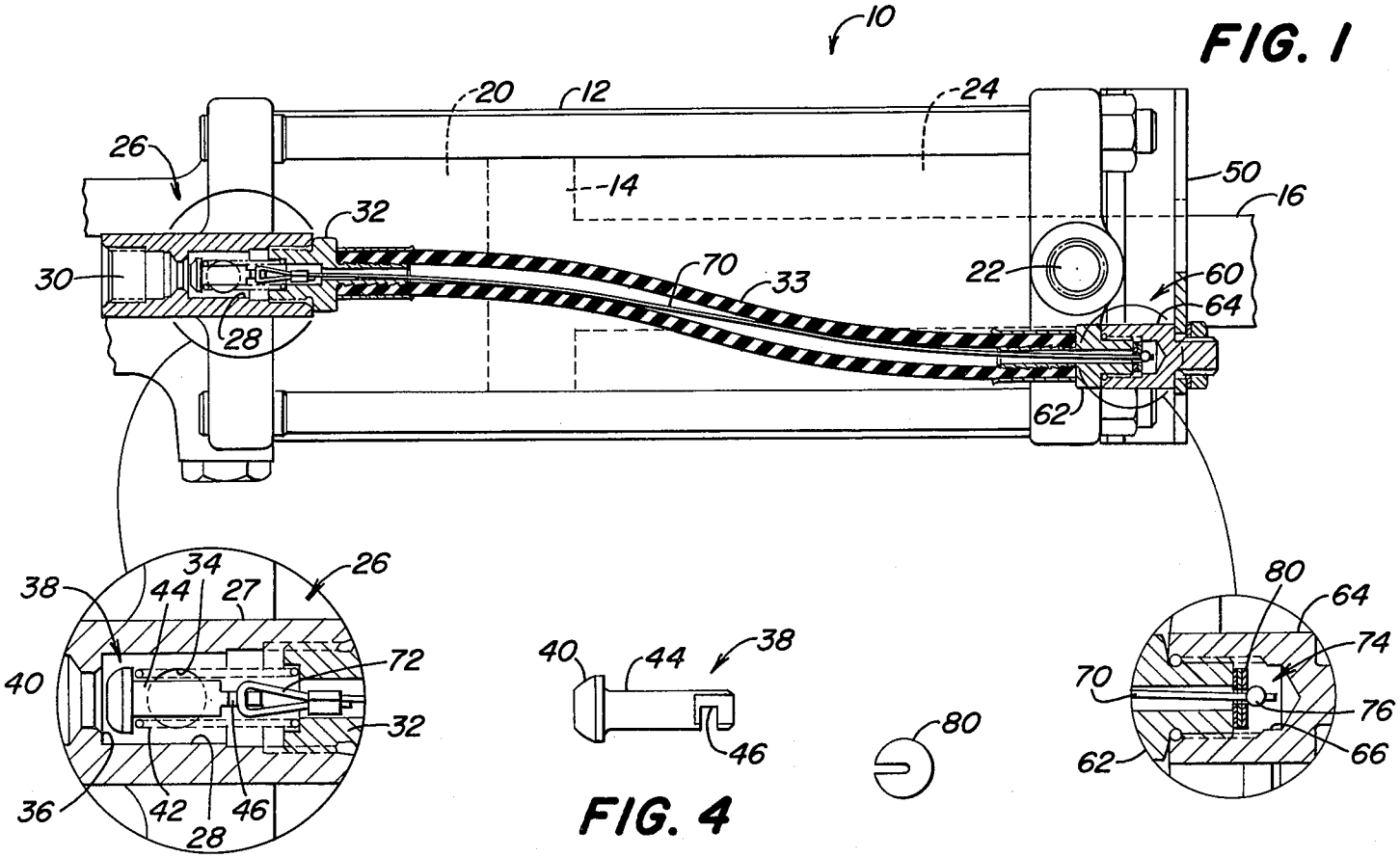
FIG. 1 is a sectional view of the stroke limiting system mounted on a hydraulic cylinder.
FIGS. 2 and 3 are detailed sectional views of portions of FIG. 1.
FIG. 4 is an enlarged view of the poppet of FIGS. 1 and 2.
FIG. 5 is an enlarged side view of the washers of FIGS. 1 and 3.

A piston and cylinder unit 10 have a cylinder 12 in which a piston 14 and rod 16 reciprocate. A fluid port 18 communicates with a chamber 20 on one side of the piston 14, while port 22 communicates with a chamber 24 on the other side of piston 14.

The stroke limiting system includes a valve 26 fixed to the head end of cylinder 12 to control fluid flow out of port 18. Valve 26 has a body 27 with a longitudinally extending bore 28 and with one end 30 adapted to be connected to a fluid pressure source, such as a sump). The other end of body 27 is theadably and sealingly attached to a hollow tube or hose fitting 32 which is sealingly attached on an end of a flexible rubber high-pressure hose or tube 33. A cross bore 34 communicates port 18 with bore 28. A portion of the body 27 has a reduced inner diameter to form a seat 36.

A poppet member 38 is movable within the bore 28 and has a head 40 which is sealingly engageable with seat 36. A spring 42, coupled between fitting 32 and poppet head 40, is biased to urge poppet head 40 towards the seat 36. Poppet 38 also has a stem 44 which extends from head 40 to an end with a notch 46.

Figure 7:
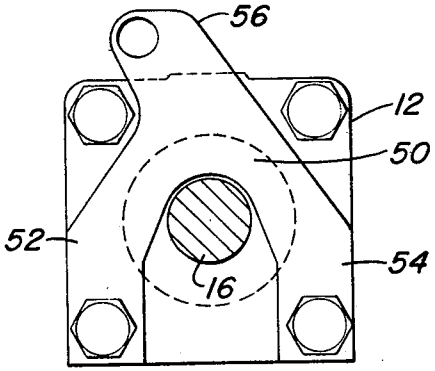
FIG. 7 is an end view of the bracket of the present invention attached to a hydraulic cylinder.

A bracket 50 has a pair of legs 52 and 54 fixed by suitable means, such as bolts, to the rod end of cylinder 12. Preferably, the bolts are undercut and spaced from the cylinder end so that the bracket 50 can pivot with respect to the end of the cylinder 12. Alternatively, the bracket 50 could be flexible. The bracket also has an apertured arm 56 which projects from legs 52 and which extends axially away from the rod end of the cylinder 12. The legs 52 and 54 are separated by an opening which receives the piston rod 16, as best seen in FIG. 7.

A hose fitting 60 has a hollow first part 62 which is sealingly attached to the other end of hose 33. A second part 64 has a blind bore 66 which threadably receives an end of the first part 62. Second part 64 also has a male threaded end by means of which it can be fixed to the end of bracket arm 56.

A cable 70 extends through hose 33 from a looped end 72 which is received by the notch 46 of poppet member 38 to an end 74 which has a swaged-on ball 76 or some other enlargement. A plurality of slotted washers engage the ball 76 and butt against an end of part 62 to prevent the end 74 of cable 70 from being withdrawn from bore 66 through fitting part 62.

Figure 6:
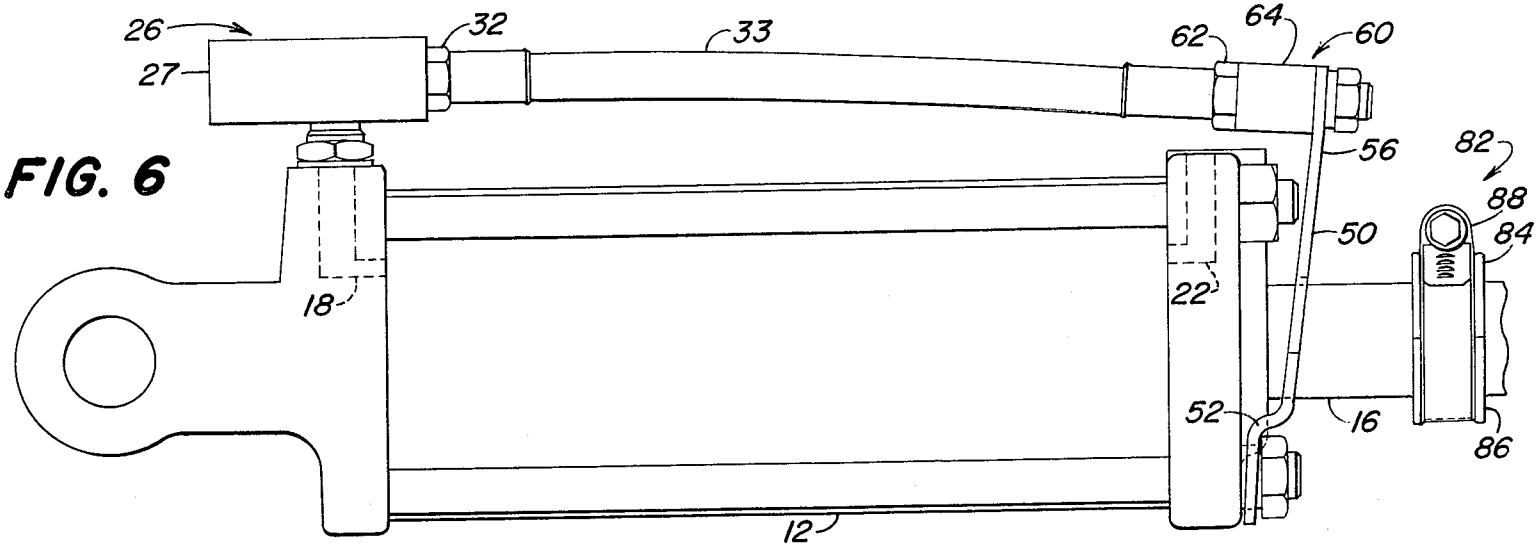
FIG. 6 is a side view of the present invention installed on a hydraulic cylinder.
Figure 8:
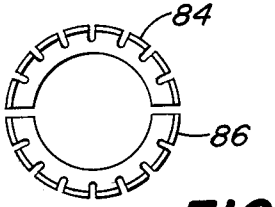
FIG. 8 is a detailed view of applicant's rod-mountable stop.

A stop 82 is fixed in a desired position on the piston rod 16, as best seen in FIG. 6. A preferred stop is formed out of two notched semi-circular hard rubber halves 84 and 86 which are secured to the piston rod 16 by means of a conventional hose clamp 88. When the rod 16 is retracted, the stop 82 engages and pivots bracket 50 and moves fitting 60 and cable end 74 towards the head end of the cylinder 12. This motion permits spring 42, along with the pressure drop across valve 26, to move poppet 38 into engagement with seat 36, thus closing valve 26, blocking fluid in chamber 20 and preventing further retraction of piston rod 16.

Preferably, as shown in FIG. 1, the ends of hose 33 are circumferentially offset from each other so that the hose 33 and the cable 70 form a gentle "S-shaped" curve therebetween. The number of washers 80 can be varied to control the amount of pivoting of bracket 50 which is required to close valve 26. Normally, pressure in the hose 33 and the stiffness of the hose keeps tension in the cable 70 sufficient to hold poppet head 40 away from seat 36 and against the bias of spring 42.

This system can be easily adapted to cylinders of different lengths by using a shorter or longer cable and hose. Since this system can tolerate a variation in circumferential offset between the hose ends, it can be easily adapted to cylinders of different diameter, configuration and style.

While the invention has been described in conjunction with a specific embodiment, it is to be understood that many alternatives, modifications and variations will be apparent to those skilled in the art in light of the aforegoing description. Accordingly, this invention is intended to embrace all such alternatives, modifications and variations which fall within the spirit and scope of the appended claims.

I claim:

1. A stroke-limiting system for a hydraulic cylinder and piston unit enclosing fluid chambers on opposite sides of the piston, having a fluid port communicated with one of the chambers, and having a piston rod extending from the cylinder, the stroke limiting system including a port valve for controlling fluid flow from the port, the port valve having a housing fixed to the cylinder and having a valve member movable in the housing to control fluid flow therethrough, a stop member adjustably fixable on the piston rod and coupling means operatively coupling the stop member to the port valve, the improvement wherein the coupling means comprises:

a hollow flexible hose member having first and second ends, the first end being rigidly fixed to the port valve housing;

a movable bracket member having a base coupled to the cylinder, an arm extending from the base to an end attached to the second end of the hose member; and a cable received by and extending through the flexible hose member, having a first end fixed to the valve member and having a second end coupled to the second end of the flexible hose member, movement of the piston and rod with respect to the cylinder causing fluid to flow out of the one chamber until the stop member engages one of the hose and bracket members and moves the end of the bracket and the second ends of the flexible hose member and cable, such movement of the second cable end causing the first cable end and the valve member to move to a position closing the port valve, blocking flow of fluid from the one chamber and preventing further movement of the piston rod.

2. The stroke limiting system of claim 1, wherein:

the first hose end is circumferentially spaced with respect to the second hose end.

3. The invention of claim 1, wherein the bracket member comprises:

a pair of legs forming an opening therebetween for receiving the piston rod, the legs having ends for attachment to the cylinder.

4. The invention of claim 1, wherein:

the port valve is fixed to a head end of the cylinder and the bracket is fixed to a rod end of the cylinder.

5. The invention of claim 1, wherein the stop member is engageable with a portion of the bracket member.

6. The invention of claim 1, wherein:

the port valve housing has an open end sealingly fixed to the first hose end and receiving the cable, the hose having an interior exposed to fluid pressure from the port via the open end of the valve housing and the second hose end being sealingly closed to prevent contamination of the port valve.

7. The invention of claim 6, further comprising:

a fitting including a first hollow cylindrical part which sealingly receives the second hose end and a second part threadably attached to the first part and to the support and including a blind bore extending therein, the cable extending through the first part to the second cable end which is received by the blind bore of the second part.

8. The invention of claim 7, further comprising:

a washer received by the blind bore, having one side engaging an end of the first part, having a slot receiving the cable and having a second side engaging an enlarged portion of the second cable end to prevent removal of the cable's second end from the blind bore.

9. A stroke limiting system for a hydraulic cylinder and piston unit enclosing fluid chambers on opposite sides of the piston, having a fluid port communicated with one of the chambers, and having a piston rod extending from the cylinder, comprising:

a port valve comprising a housing fixed to an end of the cylinder, the housing having a passage therein communicated with the fluid port, the port valve further comprising a valve member movable in the housing between an open position and a closed position and a valve spring urging the valve member towards the closed position;

a hollow flexible hose member having first and second ends, the first end being sealingly fixed to the port valve housing;

a movable bracket member having a base coupled to the cylinder and an arm extending from the base to an end attached to the second end of the hose member;

a cable received by and extending through the flexible hose member having a first end fixed to the valve member and having a second end coupled to the second end of the flexible hose member; and a stop member adjustably fixable on the piston rod, movement of the piston and rod with respect to the cylinder causing fluid to flow through the fluid port until the stop member engages one of the hose and bracket members and moves the second ends of the flexible hose and cable, such movement of the cable second end moving the first cable end to permit the valve spring to move the valve member to its closed position to prevent fluid flow through the fluid port, thus preventing further movement of the piston rod.

10. A stroke limiting system for a hydraulic cylinder and piston unit enclosing fluid chambers on opposite sides of the piston, having a fluid port communicated with one of the chambers and having a piston rod extending from the cylinder, comprising:

a port valve having a housing fixed to a head end of the cylinder, the housing defining an inlet communicating with the port, an outlet, a bore communicating the inlet with the outlet, a wall of the bore forming a valve seat, the port valve also having a valve member movable in the bore to an open position spaced apart from the valve seat and to a closed position engaging the valve seat, and a valve spring biasing the valve member towards the closed position;

a hollow flexible hose member having first and second ends, the first end being rigidly and sealingly fixed to the port valve housing;

a movable resilient support member having a first end pivotally coupled to a rod end of the cylinder and a second end fixed to the second end of the flexible hose;

a cable received by the flexible hose and having a first end coupled to the valve member and a second end fixed with respect to the second end of the flexible hose; and stop means adjustably fixable on the piston rod, retraction of the piston and rod with respect to the cylinder causing fluid to flow through the fluid port until the stop means engages one of the hose and support members and moves the second end of the flexible hose and cable, such movement of the second cable end moving the first cable end to permit the valve spring to move the valve member to its closed position to prevent fluid flow through the fluid port, thus preventing further retraction of the piston rod.

* * * * *